US008813792B2

(12) United States Patent
Ehlers et al.

(10) Patent No.: US 8,813,792 B2
(45) Date of Patent: Aug. 26, 2014

(54) TOOL AND METHOD FOR DRAINING AND REFILLING A COOLING SYSTEM

(75) Inventors: Mark Ehlers, Fort Wayne, IN (US); Karl Reith, Auburn, IN (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 567 days.

(21) Appl. No.: 13/163,226

(22) Filed: Jun. 17, 2011

(65) Prior Publication Data

US 2012/0318404 A1 Dec. 20, 2012

(51) Int. Cl.
*B65B 31/00* (2006.01)
*F01P 11/02* (2006.01)

(52) U.S. Cl.
CPC ..... *B65B 31/00* (2013.01); *F01P 11/0204* (2013.01)
USPC ..... 141/8; 141/65; 141/98; 141/301

(58) Field of Classification Search
CPC .... F01P 11/02; F01P 11/0204; F01P 11/0276
USPC ..... 141/5, 8, 59, 65, 67, 98, 301–302; 184/1.5
See application file for complete search history.

(56) References Cited

U.S. PATENT DOCUMENTS

| | | | | |
|---|---|---|---|---|
| 5,524,681 | A * | 6/1996 | Davies et al. | 141/92 |
| 6,152,193 | A | 11/2000 | Klamm | |
| 6,213,175 | B1 * | 4/2001 | Rome et al. | 141/98 |
| 6,604,557 | B2 * | 8/2003 | Awad | 141/65 |
| 6,959,717 | B2 | 11/2005 | Knowles et al. | |
| 7,213,619 | B2 * | 5/2007 | Awad | 141/5 |
| 8,590,580 | B2 * | 11/2013 | Bedi et al. | 141/8 |
| 2001/0010237 | A1 | 8/2001 | Klamm et al. | |
| 2010/0200109 | A1 | 8/2010 | Liao | |

* cited by examiner

*Primary Examiner* — Timothy L Maust
*Assistant Examiner* — Timothy P Kelly
(74) *Attorney, Agent, or Firm* — Jeffrey P. Calfa; Mark C. Bach

(57) ABSTRACT

A method of refilling coolant from a fluid cooling system of an engine, where the fluid cooling system has a surge tank or pressure cap, includes the steps of sealingly connecting a storage tank of a coolant management tool to a drainage port of the cooling system, wherein the drainage port is located at the bottom of the fluid cooling system. The storage tank stores the coolant to refill the cooling system. The method includes installing a vacuum module to the surge tank or pressure cap. The method also includes the steps maintaining a vacuum while drawing at least a portion of the coolant from the storage tank up through the drainage port, up through the cooling system, and to a level just upstream of the vacuum module.

20 Claims, 7 Drawing Sheets

TOOL AND METHOD FOR DRAINING AND REFILLING A COOLING SYSTEM

BACKGROUND

Embodiments described herein relate generally to tools and methods for engine maintenance, and more particularly, to a tool and a method for draining and refilling a cooling system of an engine.

Repair and maintenance of the engine periodically includes draining and refilling the coolant in the cooling system of an engine, such as in a vehicle, boat or stationary water-cooled engine. Typically, a petcock is located at the bottom of a radiator or radiator pipe of the cooling system. To drain the cooling system, the petcock is opened to allow the coolant to flow out of the cooling system under gravity. A cap at the top of the radiator or cooling system is also removed to allow air to enter the cooling system, so that a vacuum does not impede the flow of coolant out of the petcock. Alternatively, the cap of a radiator or cooling system is opened to allow the air to flow into the cooling system.

After the repair or maintenance, if the coolant is not contaminated before or during the draining process, often the drained coolant is placed back into the cooling system. Technicians draining the coolant typically collect the coolant in a pan located beneath the petcock. In the pan, the coolant is open to contamination and is also susceptible to spilling.

After the coolant is drained from the engine, the cooling system is re-filled with coolant. The petcock is closed and coolant is poured into a filler neck at the top of the engine or into the surge tank. Pouring the coolant back into the cooling system can be time consuming and can often lead to spilling and contamination. Also, because of the complexity of the cooling system, air can get trapped within the cooling system. Trapped air in the cooling system can cause damage to the EGR coolers. Additionally, trapped air can result in low coolant level fault codes and warnings, or even engine shut-down caused by an engine protection system at the vehicle's engine control unit.

The conventional method to bleed the cooling system of the trapped air is to run the engine for a period of time to let the air escape the cooling system, and after the air has escaped, to add more coolant to the cooling system. Bleeding the cooling system is a time-consuming process.

SUMMARY

A method of refilling coolant from a fluid cooling system of a engine, where the fluid cooling system has a surge tank or pressure cap, includes the steps of sealingly connecting a storage tank of a coolant management tool to a drainage port of the cooling system, wherein the drainage port is located at the bottom of the fluid cooling system. The storage tank stores the coolant to refill the cooling system. The method includes installing a vacuum module to the surge tank or pressure cap. The method also includes the steps maintaining a vacuum while drawing at least a portion of the coolant from the storage tank up through the drainage port, up through the cooling system, and to a level just upstream of the vacuum module.

A method of refilling coolant to a fluid cooling system of an engine, where the fluid cooling system has a surge tank or pressure cap, includes the steps of sealingly connecting a storage tank of a coolant management tool to a drainage port of the cooling system. The drainage port is located on a lower surface of a radiator or at the lowest point of the cooling system. The storage tank stores the coolant to refill the cooling system. The method also includes the steps of installing a vacuum module to the surge tank or pressure cap, drawing at least a portion of the coolant from the storage tank up through the drainage port, up through the cooling system, and substantially up through the surge tank or pressure cap. The method further includes continuously evacuating air from the cooling system with the vacuum module until the coolant level is just beneath the vacuum module.

A method of draining coolant from a fluid cooling system of an engine and refilling the coolant to the fluid cooling system, where the fluid cooling system has a surge tank or pressure cap, includes the step of sealingly connecting a storage tank of a coolant management tool to a drainage port of the cooling system. The drainage port is located at the bottom of the fluid cooling system. The method also includes the steps of installing a pressure module to the surge tank or pressure cap, applying a higher pressure to the cooling system from the pressure module, extracting under higher pressure at least a portion of the coolant from the cooling system into the storage tank, and replacing the pressure module with a vacuum module at the surge tank or pressure cap. The method also includes evacuating air from the cooling system with the vacuum module, and maintaining a vacuum while drawing at least a portion of the coolant from the storage tank up through the drainage port, and substantially up through the cooling system, and to a level just upstream of the vacuum module.

As described above, the Tool and Method for Draining and Refilling a Cooling System provides a number of advantages, some of which have been described above and others of which are inherent in the invention. Also, modifications may be proposed to the Tool and Method for Draining and Refilling a Cooling System without departing from the teachings herein.

DETAILED DESCRIPTION

Figure 1:
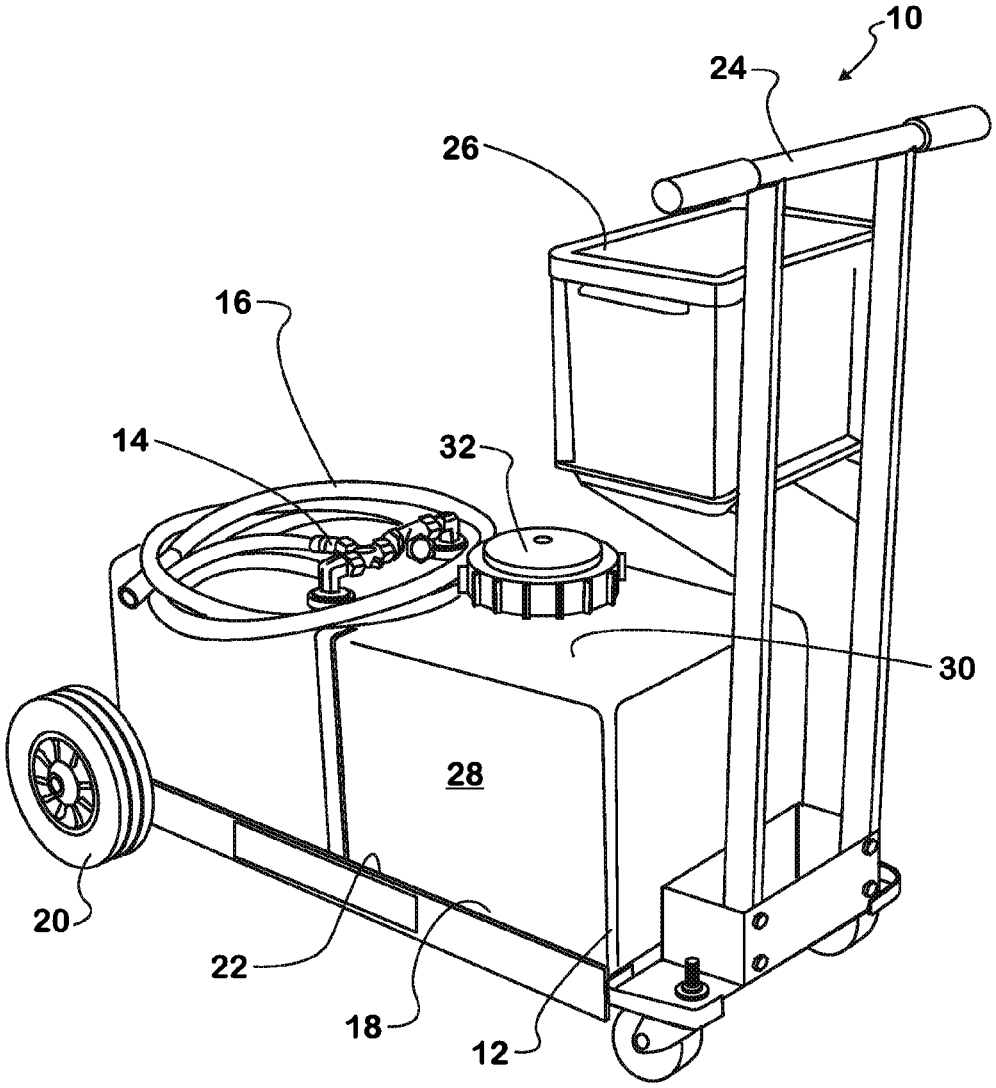
FIG. 1 is a perspective view of a tank-cart assembly of a coolant management tool.
Figure 2:
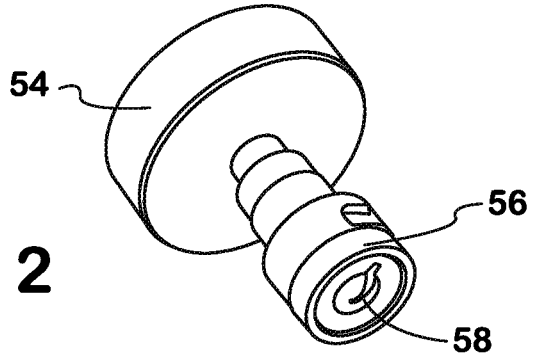
FIG. 2 is a perspective view of a cap adaptor of the coolant management tool.
Figure 3:
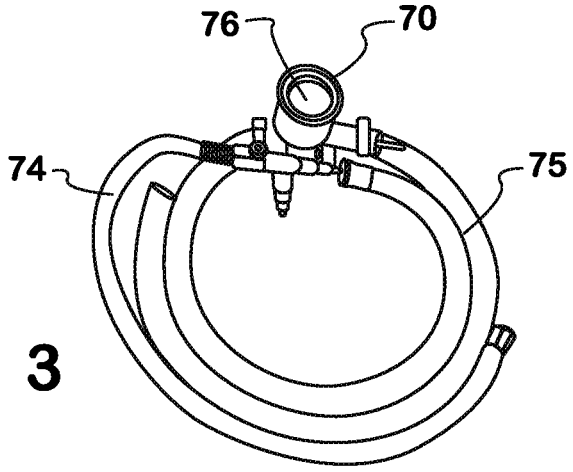
FIG. 3 is a front view of a vacuum module of the coolant management tool.
Figure 4:
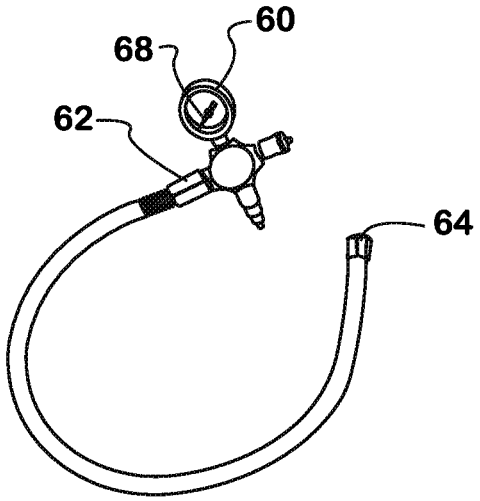
FIG. 4 is a front view of a pressure module of the coolant management tool.
Figure 5:
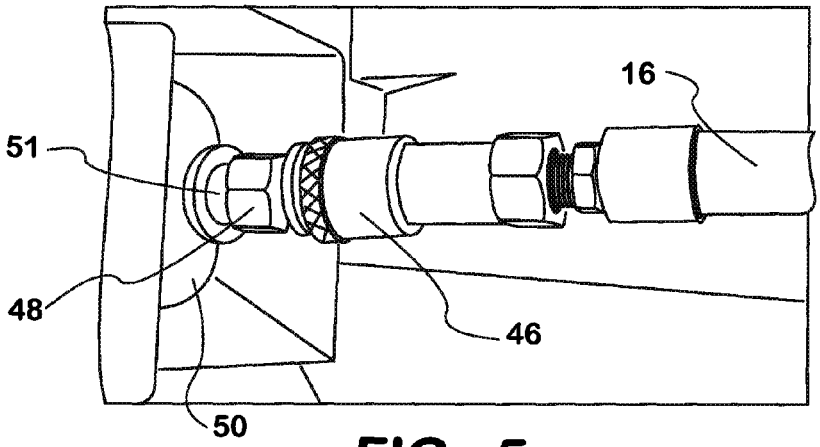
FIG. 5 is a side view of a quick-connect fitting on a radiator and a mating quick-connect fitting on a hose.
Figure 6:
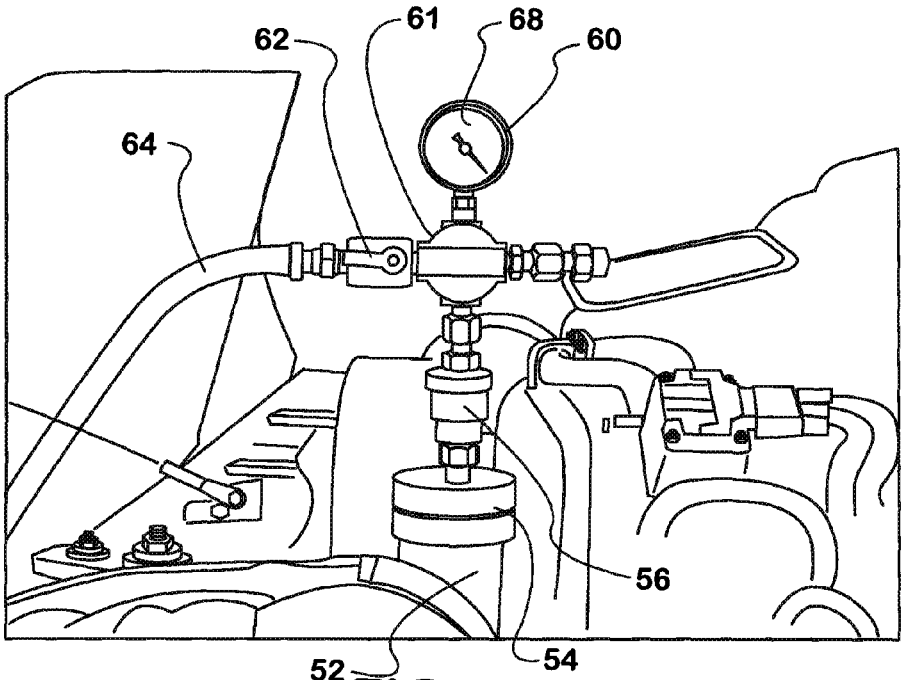
FIG. 6 is a front view of the pressure module attached to the cap adaptor of a surge tank.
Figure 7:
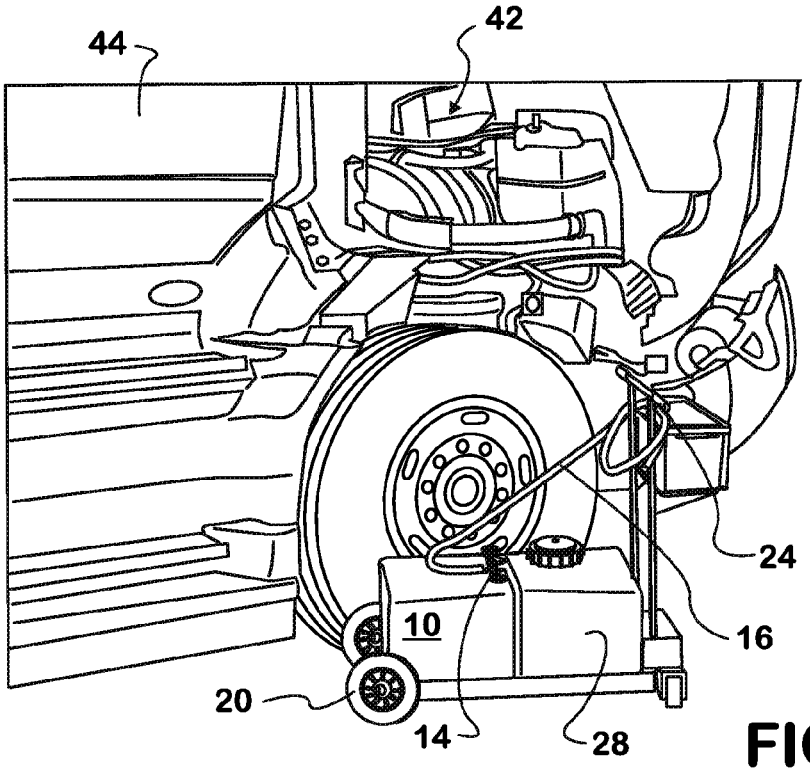
FIG. 7 is a side perspective view of the coolant management tool being used to refill coolant in a cooling system of a vehicle.
Figure 8:
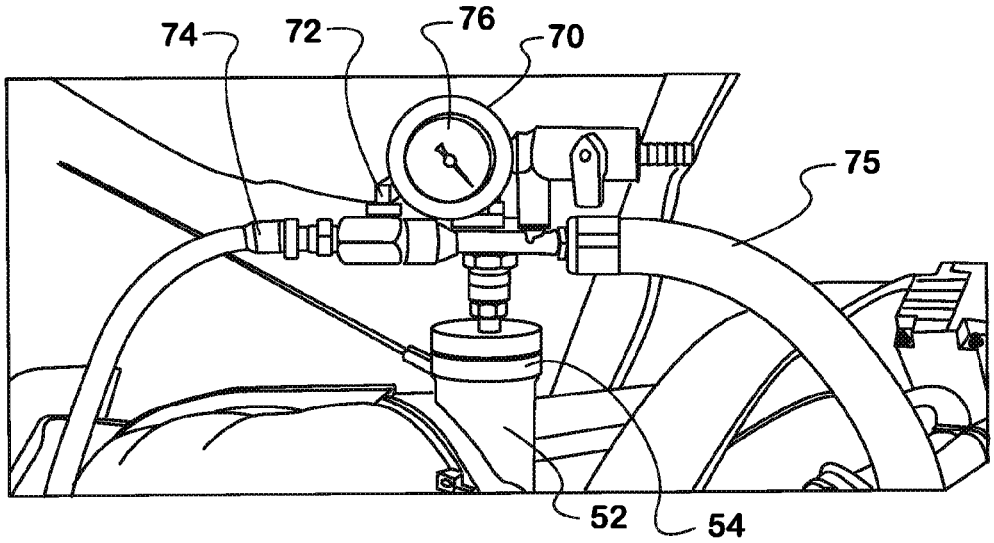
FIG. 8 is a front view of the vacuum module attached to the cap adaptor of the surge tank.
Figure 9:
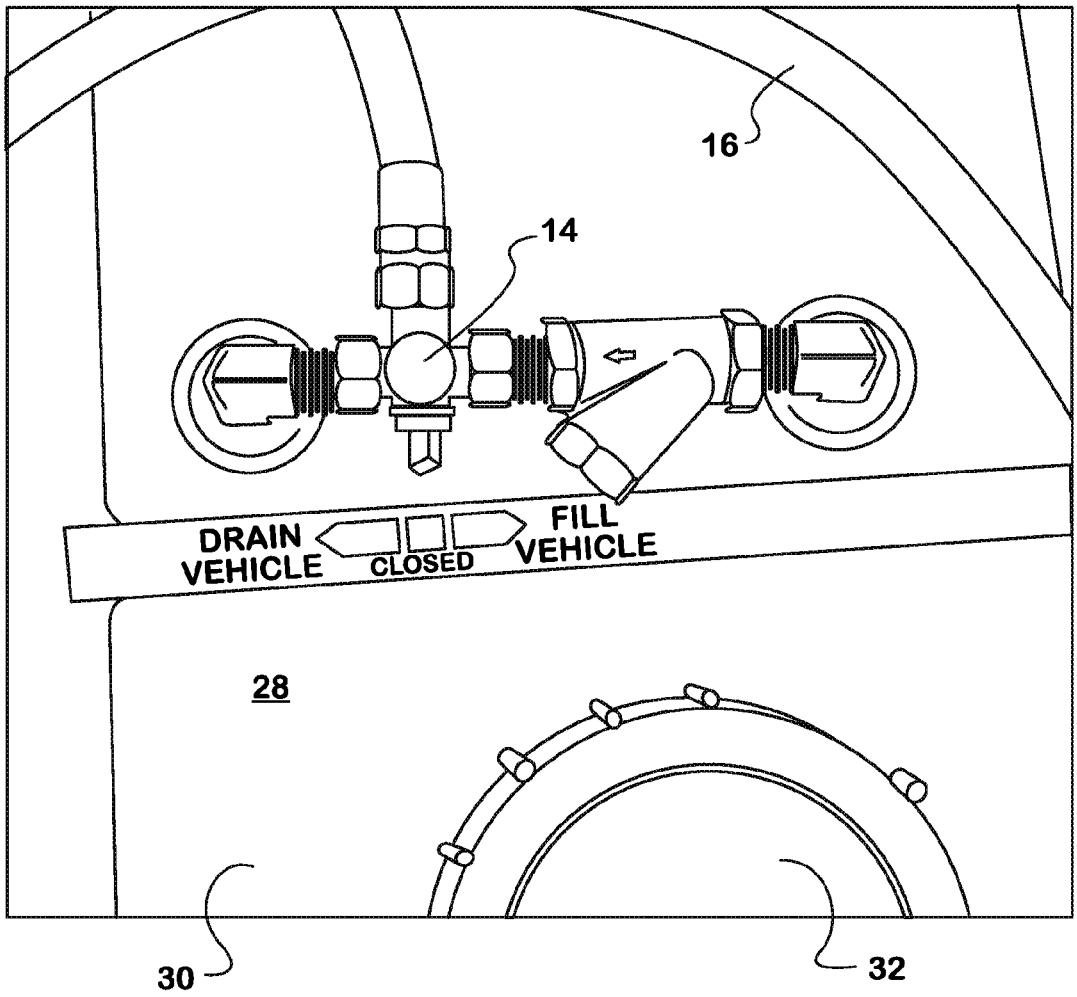
FIG. 9 is a top view of a three-way valve on a storage tank.
Figure 10:
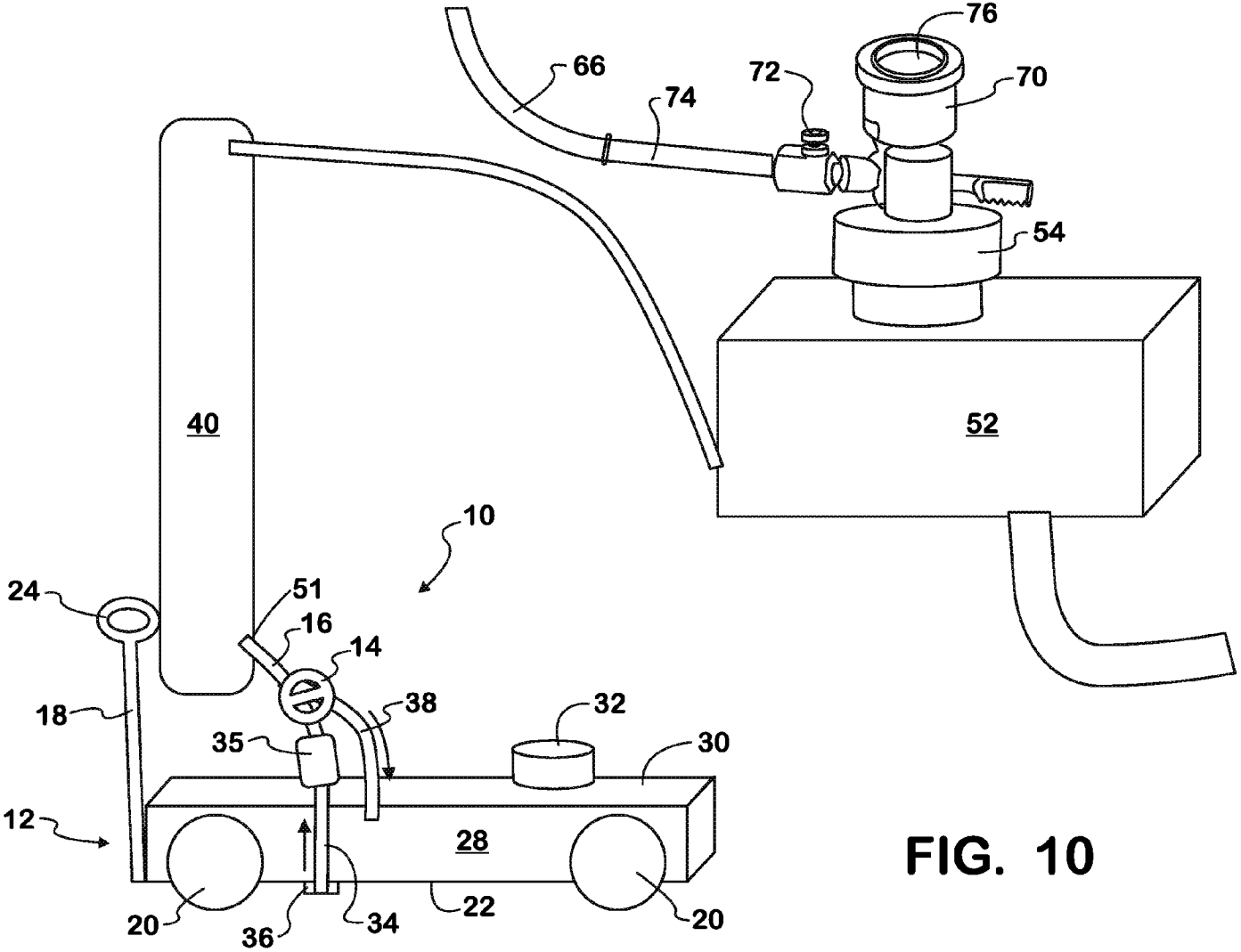
FIG. 10 is a schematic of the coolant management tool attached to the engine cooling system.
Figure 11:
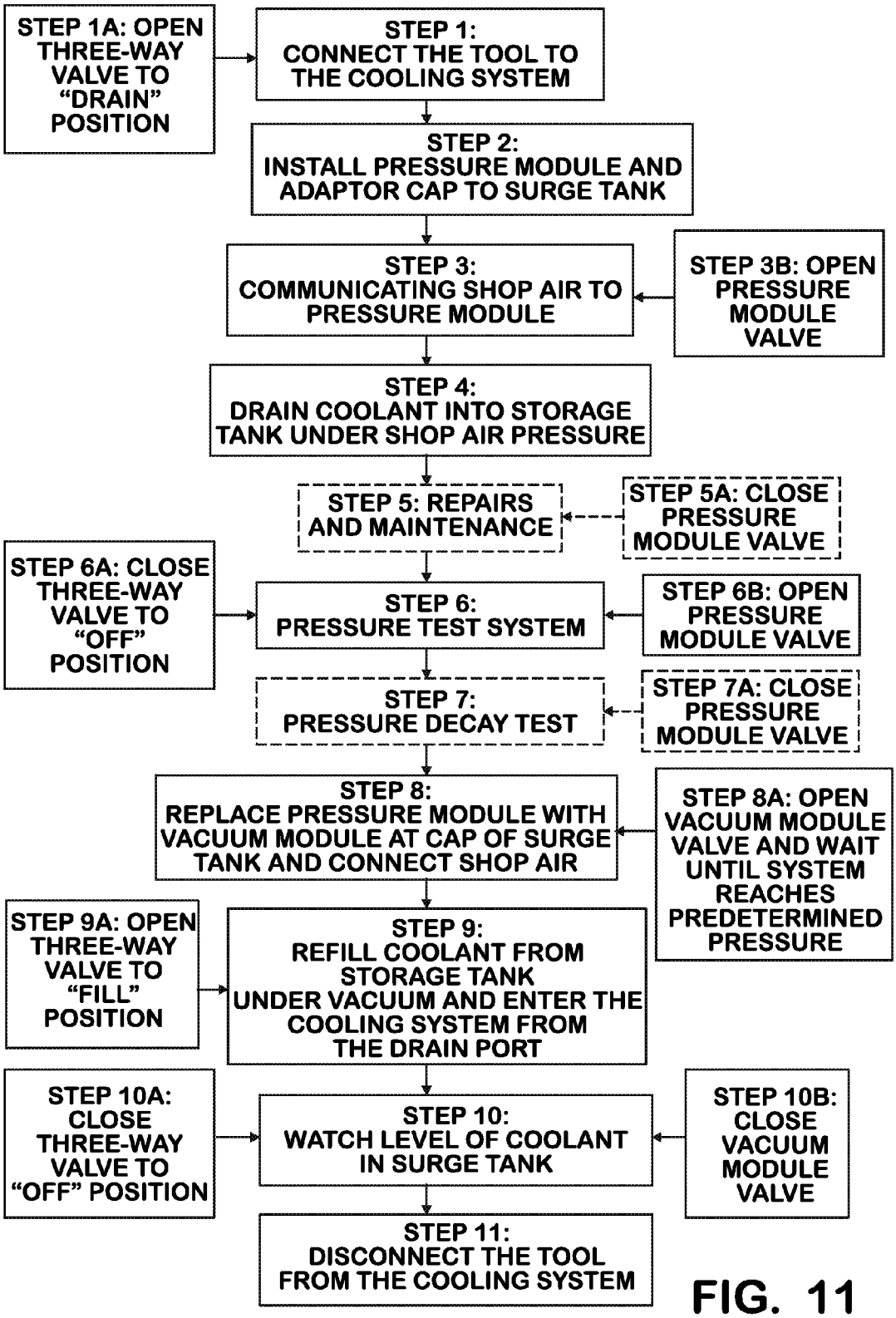
FIG. 11 is a flowchart of method steps for using the coolant management tool.

Referring to FIGS. 1-11, a coolant management tool is indicated generally at 10, and includes a tank-cart assembly 12, a three-way valve 14, and a hose 16. The tank-cart assembly 12 has a cart 18 that may be provided with a plurality of wheels 20 at four corners of a cart platform 22, however other configurations of carts are possible. A handle structure 24 may extend generally perpendicularly from the cart platform 22. Optionally, an accessory storage basket 26 may be disposed on the handle structure 24 to store accessories of the coolant management tool 10.

A storage tank 28 is received on the cart platform 22 so that it is generally portable. The storage tank 28 is an enclosed container, and may be generally rectangular-prismatic and have an internal volume of about 20-gallons, however other configurations and volumes are possible. At a top surface 30, the storage tank 28 has a cap 32 over a port for adding new coolant.

Also at the top surface 30 of the storage tank 28 is the three-way valve 14. The three-way valve 14 has three positions, a first "drain" position allowing coolant to flow into the storage tank 28, a second "fill" position allowing coolant to flow out of the storage tank, and a third "closed" position where coolant cannot enter or leave the storage tank. In the fill position, the coolant is drawn through a hose 34. A filter 35 may be disposed on the hose 34 between a one-way check valve 36 and the three-way valve 14 to filter the coolant. In the "drain" position, the coolant may enter the storage tank through a separate hose 38. With the three-way valve 14 in the "drain" position, coolant cannot exit the storage tank 28.

At step 1, the coolant management tool 10 is connected to the cooling system 40. The hose 16 extends from the three-way valve 14 and is connected to the cooling system 40 of an engine 42. The engine 42 can be an engine in a vehicle, a boat, a stationary water-cooled engine, or any other engine having a cooling system 40. To drain a full cooling system 40, the coolant management tool 10 is connected to the cooling system 40 with a quick-connect fitting 46 on the end of the hose 16. A corresponding quick-connect fitting 48 is disposed on a radiator 50 or on a lower radiator pipe at a bottom drainage port 51. If the drainage port 51 of the radiator 50 has a petcock instead of a quick-connect fitting, the petcock can be replaced or retrofitted with the quick-connect fitting member. Alternatively, the drainage port 51 may be located on the cooling system 40 other than at the radiator 50 or radiator pipe. The drainage port 51 may be located anywhere in the cooling system 40 that is in a substantially downstream location in terms of the flow of coolant under gravity. The three-way valve 14 on the storage tank 28 is opened to "drain" position to drain the coolant into the storage tank at step 1A.

At step 2, a pressure module 60 and a cap adaptor 54 are attached to a surge tank 52 of the vehicle 44. The surge tank 52 is part of the cooling system 40 and is in upstream fluid communication with the radiator 50 in terms of the direction of flow of coolant under gravity. While the following description will reference a surge tank 52 because many cooling systems have a surge tank or expansion tank, it is possible that the cooling system 40 may not have a tank. In such cooling systems, such as those that employ a pressure cap or fill area, the "surge tank" as used herein refers to the uppermost area of the cooling system 40 (in terms of the direction of flow under gravity) in which coolant can be introduced to the system, whether or not there is a tank.

The cap adaptor 54 attaches to the surge tank 52 (or uppermost area of the cooling system 40). The cap adaptor 54 has a quick-connect fitting 56 and provides a channel 58 for fluid flow. The pressure module 60 having a valve 61 and a regulator 62 is attached to the cap adaptor 54. Either directly or through a hose 64, the pressure module 60 can be attached to shop air, or some other source, through a shop air hose 66 at step 3, and the pressure module valve 61 is opened at step 3B. Shop air or other high pressure fluid (gas or air) is fluidly communicated to the pressure module 60 and through the channel 58 to the surge tank 52 of the cooling system 40. The pressure module 60 regulates the shop air with the regulator 62 to apply pressure to the cooling system 40. The regulator may be a non-adjustable 15 psi regulator. The pressure module may include a gauge 68 that indicates the pressure of the cooling system 40. The pressure module may also include a pressure relief valve to vent the surge tank 52 and the cooling system 40. The relief valve mimics the relief function of the cooling system pressure cap.

At step 4, the coolant is extracted into the storage tank 28 under high pressure of about 15 psi, however other pressures are possible. The pressure module 60 is attached to the surge tank 52 through the cap adaptor 54, and the pressure module valve 61 is opened. Using the shop air and the regulator 62, the coolant is drained out of the engine and into the storage tank 28 through hose 38 under pressure. Depending on the capacity of the storage tank 28, the storage tank may be filled partially or entirely. The coolant may be rapidly drained under pressure into the storage tank 28 in about 2-3 minutes, and since the storage tank 28 is an enclosed container, there may be no spills or contamination involved in the draining process.

When the cooling system 40 is drained of the coolant, repairs can be conducted on the engine and cooling system at optional step 5. The pressure module valve is closed during repairs at optional step 5A.

Before the cooling system 40 is re-filled with coolant, the pressure module 60 can be used to conduct a pressure test to test for leaks in the cooling system at step 6. A leak may be the result of a hose clamp or connection that is loose. With the pressure module 60 attached to the surge tank 52, and with the three-way valve 14 on the storage tank 28 closed at step 6A, the valve 61 on the pressure module is opened at step 6B. Leaks are typically audible or located by the user by spraying the area with a bubble forming solution. Optionally, after the valve 61 on the pressure module 60 is opened, the valve can be subsequently closed at step 7A to perform a pressure decay test at step 7.

To refill the coolant, the pressure module 60 is removed from the surge tank 52 and a vacuum module 70 is attached to the surge tank at step 8. The vacuum module 70 may include a valve 72 and a hose 74 extending from the valve to receive the shop air hose 66. The three-way valve 14 on the storage tank 28 is turned to the "off" position, and the valve 72 of the vacuum module 70 is turned on at step 8A. The coolant management tool 10 pulls a vacuum on the cooling system 40, which may cause a gauge 76 of the vacuum module to indicate a predetermined pressure of about 20-25" Hg vacuum.

Upon the gauge 76 indicating the predetermined pressure, the three-way valve 14 on the storage tank 28 is turned to the "fill" position at step 9A, the vacuum module 70 remains on, and coolant flows through the filter 35 into the cooling system 40 from the bottom drainage port 51, up through the fluid cooling system 40, and fills the surge tank 52. In the "fill" position, draining cannot occur due to a one-way check valve 36 located on the hose 34.

Through the vacuum created by the vacuum module 70, the coolant is drawn up into the engine cooling system 40 through the drainage port, from the bottom of the cooling system up into the surge tank 52 at step 9. The term "bottom" generally refers to a point on the cooling system 40 that has a low elevation when the vehicle is horizontal. The vacuum allows the coolant to flow up substantially or entirely through the cooling system 40, countering gravity. The vacuum applied by the vacuum module 70 is continuously maintained until the level of the coolant drawn up through the bottom of the cooling system 40 is just upstream of the vacuum module 70. The term "just upstream" of the vacuum module means that, in the direction of flow during refill of the coolant from the bottom up through the cooling system, the coolant stops short of reaching the vacuum module. In an embodiment with the surge tank 52, the surge tank may be substantially or entirely filled with the coolant. If coolant exceeds the volume of the surge tank 52 or cooling system 40, and if the coolant enters the vacuum module 70, the coolant is vented out the hose 75. The exhaust of the shop-air from the vacuum module 70 vents out the hose 75. By continuously evacuating air with the vacuum module 70, the vacuum is not terminated or degraded until the coolant level is refilled to just beneath the vacuum module.

As the user refills the coolant into the cooling system 40, the user watches the level of the coolant in the surge tank 52 at step 10, and the user turns the three-way valve 14 on the storage tank 28 to the "off" position at step 10A before air enters the cooling system. The user turns the vacuum module 70 off at step 10B as the coolant in the cooling system 40 reaches its capacity, just upstream of the vacuum module 70. The surge tank 52 may have a "full" delineation on the surge tank to aid the user in seeing when the cooling system 40 is near capacity. The three-way valve 14 on the storage tank 28 is turned off by the user, the user removes the cap adaptor 54 and the vacuum module 70 from the surge tank 52, and the user removes the quick-connect hose 16 from the drainage port 51 to disconnect the tool 10 at step 11.

Portions of the coolant management tool 10, such as the cap adapter 54, the pressure module 60 and the vacuum module 70, can be stored in the storage basket 26 when they are not in use.

With the coolant management tool 10 and method of using, the likelihood of mixing coolant types is reduced. Also, the time to drain, pressure test, refill and bleed the cooling system is reduced. By pressure testing the cooling system before coolant is added or refilled, leaks are more easily corrected without spilling or loss of coolant. Air pockets in the cooling system are also reduced and may be eliminated, which protects the EGR coolers. Since the method is contained in closed containers and hoses, the likelihood of spilling or contaminating the coolant is reduced.

While specific embodiments have been described in detail in the foregoing detailed description and illustrated in the accompanying drawings, those with ordinary skill in the art will appreciate that various permutations of the invention are possible without departing from the teachings disclosed herein. Accordingly, the particular arrangements disclosed are meant to be illustrative only and not limiting as to the scope of the invention, which is to be given the full breadth of the appended claims and any and all equivalents thereof. Other advantages to a Tool and Method for Draining and Refilling a Cooling System may also be inherent in the invention, without having been described above.

What is claimed is:

1. A method of refilling coolant from a fluid cooling system of an engine, the fluid cooling system having a surge tank or pressure cap, the method comprising the steps of:

sealingly connecting a storage tank of a coolant management tool to a drainage port of the fluid cooling system, wherein the drainage port is located at the bottom of the fluid cooling system, wherein the storage tank stores the coolant to refill the fluid cooling system, and wherein the coolant management tool has a three-way valve selectively controlling fluid communication between the storage tank and the fluid cooling system;

installing a vacuum module to the surge tank or pressure cap;

establishing a vacuum within the fluid cooling system;

opening the three-way valve selectively controlling fluid communication between the storage tank and the fluid cooling system; and maintaining the vacuum while drawing at least a portion of the coolant from the storage tank up through the drainage port, up through the fluid cooling system, and to a level just upstream of the vacuum module.

2. The method of claim 1 wherein the drainage port is located on a lower surface of a radiator.

3. The method of claim 1 wherein the storage tank is an enclosed container having an internal volume.

4. The method of claim 1 further comprising attaching a cap adaptor to the surge tank or pressure cap, and attaching the vacuum module to the cap adaptor.

5. The method of claim 1 further comprising drawing the coolant into the storage tank through a hose.

6. The method of claim 1 wherein the storage tank is sealingly connected to the fluid cooling system with a hose having a quick-connect fitting that mates with a corresponding quick-connect fitting of the fluid cooling system.

7. The method of claim 1 wherein the coolant management tool comprises:

a hose extending from the three-way valve to sealingly connect to the drainage port of the fluid cooling system.

8. The method of claim 7 wherein the coolant management tool further comprises an adaptor cap having a channel for drawing air from the surge tank to the vacuum module.

9. The method of claim 1 wherein the coolant management tool comprises a tank-cart assembly having a cart platform for supporting the storage tank, and plurality of wheels disposed on the cart platform.

10. A method of refilling coolant to a fluid cooling system of an engine, the fluid cooling system having a surge tank or pressure cap, the method comprising the steps of:

sealingly connecting a storage tank of a coolant management tool to a drainage port of the fluid cooling system, wherein the drainage port is located on a lower surface of a radiator, wherein the storage tank stores the coolant to refill the fluid cooling system, and wherein the coolant management tool has a three-way valve disposed on the storage tank selectively controlling fluid communication between the storage tank and the fluid cooling system, the three-way valve having a fill position;

installing a vacuum module to the surge tank or pressure cap;

establishing a vacuum within the fluid cooling system;

opening the three-way valve disposed on the storage tank drawing at least a portion of the coolant from the storage tank up through the drainage port, and substantially up through the cooling system; and continuously evacuating air from the fluid cooling system with the vacuum module until the coolant level is just beneath the vacuum module.

11. The method of claim 10 wherein the storage tank is an enclosed container having an internal volume.

12. The method of claim 10 further comprising attaching a cap adaptor to the surge tank, and attaching the vacuum module to the cap adaptor, wherein the coolant is drawn substantially up through the surge tank.

13. The method of claim 10 wherein the coolant management tool comprises:

position; and a hose extending from the three-way valve to sealingly connect to the drainage port of the cooling system.

14. The method of claim 13 wherein the coolant management tool comprises:

a second hose extending from an internal volume of the storage tank to the three-way valve; and a filter disposed on the second hose to filter coolant between the storage tank and the three-way valve.

15. The method of claim 10 wherein the coolant management tool further comprises an adaptor cap having a channel for drawing a vacuum on the fluid cooling system.

16. The method of claim 10 wherein the coolant management tool comprises a tank-cart assembly having a cart platform for supporting the storage tank, and plurality of wheels disposed on the cart platform.

17. A method of draining coolant from a fluid cooling system of an engine and refilling the coolant to the fluid cooling system, the fluid cooling system having a surge tank or pressure cap, the method comprising the steps of:

sealingly connecting a storage tank of a coolant management tool to a drainage port of the fluid cooling system, wherein the drainage port is located at a bottom of the fluid cooling system, and wherein the coolant management tool has a three-way valve selectively controlling fluid communication between the storage tank and the fluid cooling system, the three-way valve having a drain position, a fill position, and an off position;

installing a pressure module to the surge tank or pressure cap;

applying a higher pressure to the fluid cooling system from the pressure module;

extracting under higher pressure at least a portion of the coolant from the fluid cooling system into the storage tank;

replacing the pressure module with a vacuum module at the surge tank;

evacuating air from the cooling system with the vacuum module;

opening the three-way valve controlling fluid communication between the storage tank and the fluid cooling system; and maintaining a vacuum while drawing at least a portion of the coolant from the storage tank up through the drainage port, up through the cooling system, and to a level just upstream of the vacuum module.

18. The method of claim 17 wherein the drainage port is located on a radiator.

19. The method of claim 17 further comprising drawing at least a portion of the coolant from the storage tank substantially up through the surge tank.

20. The method of claim 17 wherein the coolant management tool further comprises:

a hose extending from the three-way valve to sealingly connect to the drainage port of the fluid cooling system;

a second hose extending from an internal volume of the storage tank to the three-way valve; and a filter disposed on the second hose to filter coolant between the storage tank and the three-way valve.

* * * * *